United States Patent [19]

Neal

[11] Patent Number: 4,776,988

[45] Date of Patent: Oct. 11, 1988

[54] APPARATUS FOR VARYING CARBURETOR FUEL METERING JET

[76] Inventor: Patrick J. Neal, 2820 N. Highland, Tucson, Ariz. 85719

[21] Appl. No.: 107,056

[22] Filed: Oct. 13, 1987

[51] Int. Cl.[4] ..... F02M 19/04

[52] U.S. Cl. ..... 261/34.1; 261/71; 261/72.1

[58] Field of Search ..... 261/34.1, 71, 72.1

[56] References Cited

U.S. PATENT DOCUMENTS

| | | | |
|---|---|---|---|
| 2,512,225 | 6/1950 | Derner | 261/71 |
| 2,951,690 | 9/1960 | Eberline | 261/71 |
| 2,973,947 | 3/1961 | Sterner | 261/23.2 |
| 3,307,836 | 3/1967 | Arndt et al. | 261/34.1 |
| 3,469,825 | 9/1969 | DuBois | 261/DIG. 38 |
| 3,807,707 | 4/1974 | Johnson | 261/23 A |
| 4,100,663 | 7/1978 | Crum | 261/34.1 |
| 4,275,015 | 6/1981 | von Delden | 261/34.1 |
| 4,277,423 | 7/1981 | Noguez | 261/34.1 |
| 4,556,032 | 12/1985 | Miller | 261/34.1 |

FOREIGN PATENT DOCUMENTS

| | | | |
|---|---|---|---|
| 1801491 | 8/1969 | Fed. Rep. of Germany | 261/71 |

*Primary Examiner*—Tim Miles

*Attorney, Agent, or Firm*—J. Michael McClanahan

[57] ABSTRACT

Apparatus for adjustment of the main metering jet of a modular type high performance engine carburetor avoiding the problem of having to partially disassemble the carburetor in order to change the main metering jets. The invention includes a continuously adjustable elongated metering rod having a tapering point proximate the fuel orifice hole of an elongated cylindrical fuel metering jet, the rod adapted to pass horizontally through the carburetor float bowl module to the outside of the carburetor for external adjustment. The main metering jet is modified by a transverse located opening to pass fuel to the longitudinal fuel orifice hole with a second larger diameter concentric longitudinal hole adapted to receive and guide the metering rod pointed end into the fuel orifice hole. The metering rod passing through the wall of the float bowl module is rendered liquid-tight by means of closely threaded internal threads on an inside bushing mating with external threads on the metering rod, and an O-ring between the head of the bushing and the wall of the float bowl module with a nut screwed onto the external threads of the bushing shank exteriorly to the float bowl module. The metering rod presents a screwdriver slot for manual rotational fuel adjustment.

8 Claims, 1 Drawing Sheet

APPARATUS FOR VARYING CARBURETOR FUEL METERING JET

BACKGROUND OF THE INVENTION

1. Field of the Invention.

The field of the invention is modifications to internal combustion engine carburetors to manually adjust the fuel rate flow through the main metering jets .

2. Description of the Related Art.

In the world of high performance internal combustion engines utilized primarily in racing cars and high speed boats, engine performance is dependent upon many different factors. One of the factors which effects engine performance at any one time is the environmental conditions, namely the air temperature, humidity, and altitude. In consideration of these environmental factors, the main metering jets on the engine carburetor through which the fuel is regulated to the engine becomes of utmost importance.

Presently, most high performance engines are adapted to use Holley brand high performance carburetors of the modular type, usually of 4-barrel configuration, where the carburetor has a main center section module containing four down draft venturi air throats into which the fuel is sprayed to be atomized, the fuel-/air mixture then proceeding to the intake manifold and on to the individual cylinders through the intake valves. Attached on opposite sides of the carburetor main body module are the left and right metering block modules which, among other purposes, provide a passageway for the fuel moving into each of the throats of the carburetor 4-barrels. Adjacent each of the metering block modules are the float bowl modules which may be analogous to an open cup laying on its side. The float bowl module attaches to the metering block in a liquid-tight configuration, utilizing a gasket, and holds fuel interiorly at a fixed level generally determined by a float operated valve.

The fuel passageway in the fuel metering block communicates to the float bowl module at a point below the level of the fuel in the float bowl module and terminates into a larger diameter threaded hole into which the main metering jet is screwed. The main metering jet is thus totally below the fuel level in the float bowl module and has a longitudinal orifice therethrough which is of a fixed diameter, this orifice being the means by which fuel is metered from the float bowl module through the metering block and into the throat of one of the barrels of the carburetor main body module. If the carburetor is of the 4 "barrel" type, there will be four main metering jets, one for each barrel with two on each side of the carburetor protruding into the float bowl module.

The present state of the art requires that a racing enthusiast carry with him four sets of not less than six, nor usually more than twelve, individual standard stock main metering jets, each having a fuel metering orifice of a different diameter, each metering jet being the optimum jet for one set of particular environmental conditions. Currently, the Holley brand standard stock main metering jets Numbers 78 through 84 are the most common used by the inventor. The particular number of a jet does not necessarily correspond to the diameter of the orifice, but is merely a system of identifying different diameter jets.

Depending upon the various conditions under which the racer is to run his high performance engine, if a change of main metering jets is required, the operator must now firstly remove the fuel line to the float bowl module, remove the float bowl module from each side of the carburetor, spilling the gas in the module at that time upon the engine, and then unscrew each of the two main metering jets threaded into the two metering blocks. Then the operator must screw in the desired main metering jets and then reattach each of the float bowl modules to the metering blocks. The engine is then tested and if the operator selected the wrong size metering jet, he must select another jet and repeat the operation. Since a liquid-tight gasket fits between the edge of the float bowl module and the metering block module, the operator must be sure that the gasket is properly in place, and, that the gasket is not worn such that fuel might leak past it. The float bowl module is held to the metering block module by 2 to 4 elongated screws which surround the float bowl module.

Obviously the above operation takes some considerable time to accomplish and there's always the opportunity that anticipating certain weather conditions, the jets were changed some time prior to the race, however, the environmental conditions changed immediately prior to the race and the operator is left with insufficient time to make the race with the proper jets. Such would be the case at the occurrence of a sudden thunder storm which would add large amounts of humidity to the air. The inventor has experienced situations where he was unable to enter into a planned race because there was not sufficient time to change the main metering jets on the carburetor between the time that it was decided such a change was necessary and the start of the race.

Prior art devices regulating fuel flow in modular type carburetors are known, for example Johnson, in U.S. Pat. No. 3,807,707 details a device providing for adjustment of fuel moving in an inserted plate between the fuel reservoir and the carburetor main body. Such device requires a totally new manufactured part and the adjustment is made from the top of the carburetor which may require the prior removal of the carburetor air cleaner.

Accordingly, it is obvious that the need for a method and apparatus by which the effective orifice size of the main metering jets may be changed upon a minute's notice and accomplished within a minute or so without having to break down the carburetor modules and as such would be a great improvement in racing efficiency.

SUMMARY OF THE INVENTION

This invention relates to a device for manually changing the effective orifice size of the main metering jets of a carburetor where the change can be made practically instantaneously, and the change can be made in known increments to correspond to standard stock main metering jets in high performance internal combustion carburetors.

More particularly, the invention comprises an elongated metering rod having a pointed end adapted to ride proximate to and/or into the orifice of the carburetor main metering jets wherein the placement of the metering rod pointed end relative to the jet orifice may be easily regulated externally to the carburetor. Such is accomplished by aligning the elongated metering rod in position to the horizontal orifice of the main metering jet. The elongated metering rod then penetrates the wall of the float bowl module opposite the metering jet for an external access. An elongated bushing with a longitudinal hole is included, the bushing having internal threads interiorly to the longitudinal hole and external threads along the outside of the elongated shank. The bushing is seated in an opening drilled in the wall of the float bowl module opposite the main metering jet and a nut is screwed upon the bushing shank external threads protruding from the float bowl module wall. An O-ring between the head of the bushing and the inside wall of the float bowl module renders the penetration liquid-tight.

External threads upon a portion of the elongated metering rod mate with the internal threads of the bushing so that the metering rod may be rotationably adjusted in and out of the main metering jet orifice. A screwdriver slot is provided at the end of the metering rod which protrudes outside the carburetor and provides means by which the metering rod may be rotatably adjusted in and out of the main metering jet orifice. A particular thread is selected for the internal thread of the inside bushings and the external threads of the metering rod so that standard stock sizes of main metering jets correspond to fixed numbers of turns or partial turns of the metering rod.

It is an object of the subject invention to provide a device which mechanically varies the effective orifice size of a carburetor's main metering jet.

It is another object of the subject invention to provide a device whereby the adjustment of the effective orifice size of a carburetor's main metering jet may be accomplished external to the carburetor.

It is still further another object of the subject invention to provide a device whereby a high performance carburetor need not be partially disassembled in order to change the main metering jets.

Other objects of the invention will in part be obvious and will in part appear hereinafter. The invention accordingly comprises the apparatus comprising the construction, combination of elements, and arrangement of parts which are exemplified in the following detailed disclosure and the scope of the Application which will be indicated.

BRIEF DESCRIPTION OF THE DRAWINGS

For further understanding of the nature and objects of the present invention, reference should be had to the following detailed description taken in connection with the accompanying drawings wherein.

In various views, like index numbers refer to like elements.

DETAILED DESCRIPTION OF THE PREFERRED EMBODIMENT

Figure 1:
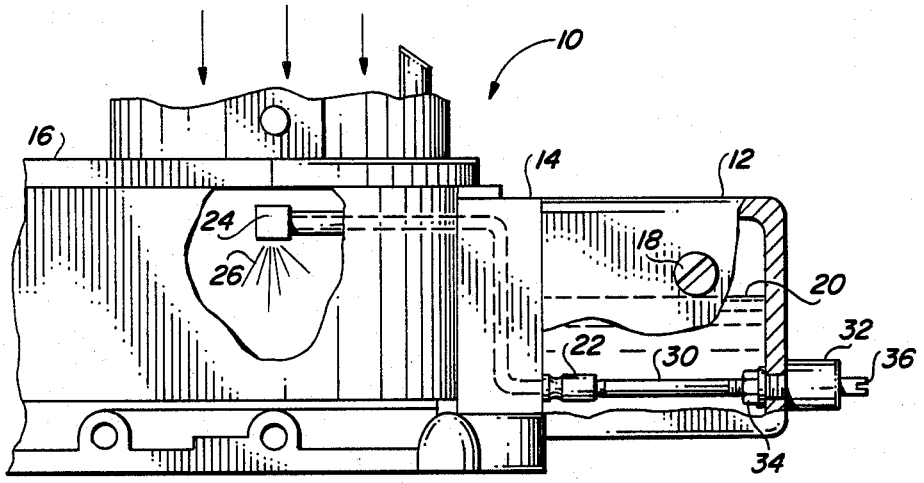
FIG. 1 is a side view of a high performance modular type carburetor shown in a partial cutaway view with the invention in place.

Referring now to FIG. 1, a side view of a high performance type carburetor, nominally a Holley brand carburetor, is shown in a partial cutaway view with the invention in place. In particular, carburetor 10 is preferably of the popularly available modular type carburetors comprising the combination of different modules. Here shown is the float bowl module 12, the metering block module 14 attached to the float bowl module, and lastly the carburetor main body module 16. The float bowl module 12 receives gasoline or other fuel via a fuel line (not shown) and maintains a reservoir of fuel at a constant fixed level, shown by the numeral 20, the level adjusted by means of float adjustment screw 18. Fuel held in float bowl module 12 passes through the main fuel metering jet 22 screwed into the wall of the metering block with the substantial portion of the metering jet located in the lower portion of float bowl module 12. From the metering jet, the fuel moves into a passageway formed in metering block module 14, shown by a dotted line connecting to main metering jet 22 and leading into the carburetor body module body 16. Once into the carburetor body module 16, the fuel is dispersed from fuel nozzle 24 in a spray in the venturi throat of carburetor body module 16 where it is atomized. The atomized fuel/air mixture is then directed to the intake manifold (not shown) for suction into the cylinders (not shown) of the automobile engine.

The subject invention is shown in the lower portion of the float bowl module 12 below the fuel level and comprises firstly elongated metering rod 30 which extends across the total width of the float bowl module 12, engaging at one end the main metering jet 22, and with the other end of metering rod 30 passing through the opposite wall of float bowl module 12 whereby external access to metering rod 30 may be obtained. Since metering rod 30 does pass through the wall of float bowl module 12, it is necessary that a liquid tight seal be maintained to prevent loss of fuel by the penetration of the wall by the metering rod. Such is accomplished by the combination of nut 32 outside the wall and cylindrical bushing 34 inside the float bowl module. Metering rod 30 has external threads (not shown in FIG. 1) at the portion along its elongated length which passes through a longitudinal hole or opening in bushing 34, bushing 34 having matching internal threads through the centrally located longitudinal hole or opening. Bushing 34 also has external threads along its elongated shank which engage internal threads of the outside nut 32. Lastly an O-ring is placed between the bushing 34 and the interior wall of the float bowl module 12. Adjustment of metering rod 30 relative to the main metering jet 22, as later explained, is accomplished by the means of screwdriver in slot 36 located at the end of metering rod 30 which resides outside the float bowl module 12.

Figure 2:
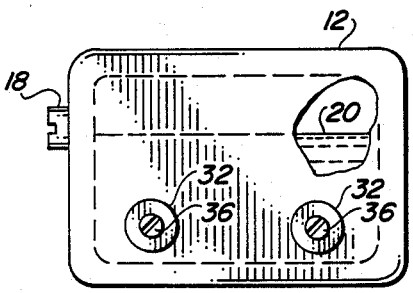
FIG. 2 is a front view of the float bowl module with the invention protrudihg from the wall of the module.

Referring now to FIG. 2, a front view of float bowl module 12 is shown with the two protruding round circular ends of metering rod 30 and the nuts 32. Also shown in FIG. 2 for purposes of continuity, is the fuel level 20 as well as the float level adjustment screw 18.

Since the invention will be primarily used on carburetors adapted for high performance engines, it is customary for these carburetors to be of the 4-barrel type and in those cases, the invention is applied to each of the 4 "barrels". Also since, in FIG. 1, the view was a partial view of the carburetor, the metering block module 14 and the float bowl module 12 is duplicated on the left hand side of the carburetor main body module 16. Each float bowl module and metering block module on each side then supplies fuel to two of the "barrels" of the carburetor, the barrels being the venturi throats leading from the outside environment, through the carburetor, and into the intake manifold, the throats interrupted by the fuel spray nozzles. The 4 "barrels" are so arranged that the center of each circular barrel, if connected, would form a square. In FIG. 2, each metering rod shown then would regulate fuel into one of the two barrels located on the right side half of the carburetor 10. Obviously, two metering rods are required. The air flow into carburetor 10 from the environment is shown by the arrows immediately above carburetor 10 in FIG. 1.

Figure 3:
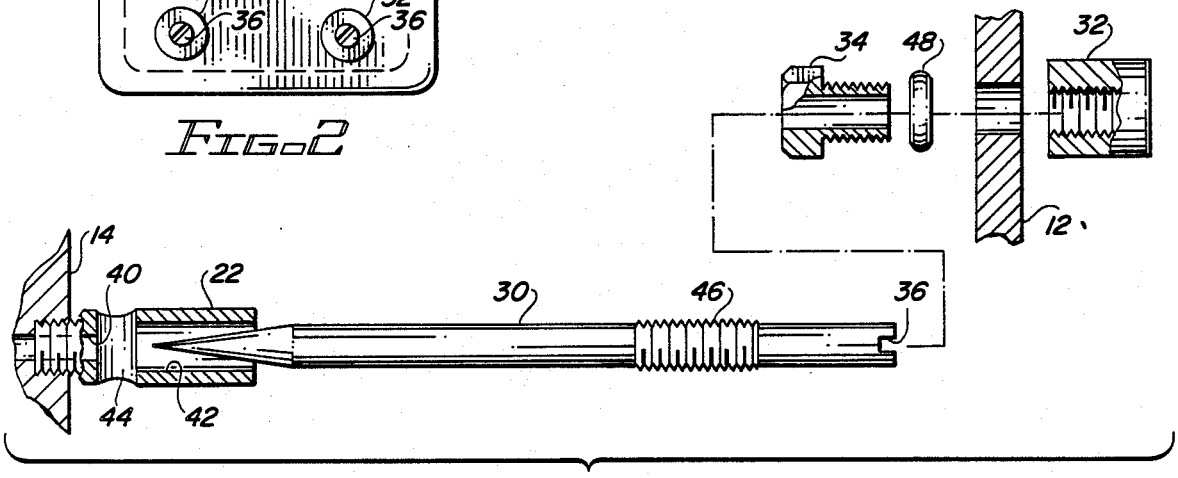
FIG. 3 is a cutaway exploded view of the invention disassembled.

FIG. 3 is an exploded view of metering rod 30 where the distance between the walls of the float bowl module have been greatly expanded, while the metering rod was left approximately in its position relative to the wall of metering block 14 while the wall of the float bowl module 12 was moved over. By this method, the external threads on the metering rod 30 are exposed. In FIG. 3, shown is the wall of the metering block module 14 into which screws the main metering jet 22. Main metering jet 22 is an elongated cylinder, having external threads at one end and having its longitudinal center hole in two stepped fixed diameters, a smaller diameter which is the fuel orifice 40 of the metering jet and into which the pointed end of metering rod 30 is inserted in order to effectively regulate the fuel passing therethrough. The larger diameter portion of the lengthwise hole 42 through the main metering jet 22 serves as a passageway to receive the sides of the metering rod 30 in a snug, but not binding, arrangement in order to align the point of the metering rod centrally in the orifice 40. Since the metering rod 30 will be substantially blocking the larger diameter passageway 42, a hole 44 is drilled transversely through the main metering jet 22 in order to allow fuel to enter the jet and pass into the orifice 40.

It is noted that no left hand wall is shown on the float bowl module 12 at the intersection with the metering block module 14 as the float bowl module 12 utilizes the wall of the metering block module 14 as its wall. The two modules are fitted together with a liquid tight gasket (not shown) in order that the fuel may be held within the bowl. The float bowl module 12 is urged against the side of the metering block module by means of a plurality of elongated machine screws (not shown) to assure a firm, liquid-tight relationship at the gasket between the two modules.

Continuing with FIG. 3, metering rod 30 has, at the portion where the rod passes through the right hand outside wall of the float bowl module 12, external threads 46 which are adapted to engage internal threads of bushing 34. In the preferred embodiment, rather fine threads are used as the external threads 46 on metering rod 30 and internal threads of bushing 34, nominally 30 threads to the inch, in order that the threads will also serve to provide a liquid-tight relationship between the metering rod 30 and the bushing 34. Bushing 34 is firmly attached to the wall of float bowl module 12 by screwing nut 32, which has internal threads, onto the external threads of bushing 34. O-ring 48 fits between the head of bushing 34 and the wall of float bowl module 12 in order that fuel may not escape around the head of bushing 34 through the opening formed in the wall of the float bowl module 12. Metering rod 30 exits out of the interior opening of nut 32 for external adjustment by means of a screwdriver engaging the screwdriver's slot 36 in its end. If deemed necessary, the opening through nut 32 may be down sized at the point of exit of metering rod 30 from the internal threads and a second O-ring placed inside to render liquid-tight the metering rod-bushing engagement.

Figure 4:
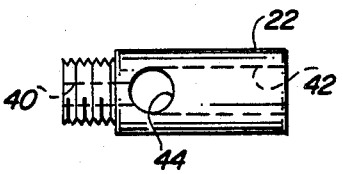
FIG. 4 is another view of the main metering jet rotated by 90-degrees from that shown in FIG. 3.

Next, referring now to FIG. 4, another view of main metering jet 22 is shown where the jet has been rotated 90-degrees in order that the transverse fuel hole 44, by which fuel enters the internal portion of main metering jet 22, may be seen. Also in FIG. 4 is shown the larger diameter hole 42, the fuel orifice hole 40, and the shoulder formed by the joinder of the larger diameter hole and the fuel orifice hole. The fuel must enter the fuel orifice hole 40 around the pointed end of the metering rod 30 and by the shoulder, and commonly a portion of the point of the rod 30 enters the smaller fuel orifice hole 40.

Operation of the subject invention is accomplished as follows. Since it is intended that various rotational positions of the fuel metering rod are intended to match different jet sizes of fixed orifice main metering jets, the metering rod 30 is first screwed inwardly by means of a screwdriver in screwdriver slot 36 until the pointed end of the metering rod bottoms against the shoulder at the smaller diameter fuel orifice hole 40. At this point, no fuel can pass into the fuel orifice hole 40 and a reference point is established. Next, the main metering rod 30 is unscrewed 3 turns, which it has been found corresponds to a number 70 standard stock main metering jet. Rotating metering rod 30 another one-half turn outward or away from the fuel orifice hole 40, results in the fuel passing capacity equal to number 71 standard stock main metering jet. This procedure is continued until substantially the pointed edd of the metering rod no longer is restricting the fuel coming into the transverse fuel hole 44 of main metering jet 22 or restricting the fuel passing into the fuel orifice hole 40. At this point, the fuel passing into the fuel orifice hole 40 is now equivalent to a number 100 standard stock main metering jet which is substantially the largest jet conceivably usable on a high performance engine. When the main metering jet 22 was constructed, it was designed to present an effective fuel orifice size equivalent to the largest standard stock main metering jet fuel passage capacity.

The numbers utilized above representing the standard stock fuel metering jets are those standard stock fuel metering jets available for interchanging in the Holley brand high performance carburetors used on high performance engines. Thus it is readily apparent that the problem of having to remove the float bowl module of a Holley carburetor, or any other similarly constructed carburetor for the purpose of interchanging the main metering jet to adjust to different environment and racing or performance conditions is avoided by use of the subject invention and the adjustment provided of the metering rod.

Figure 5:
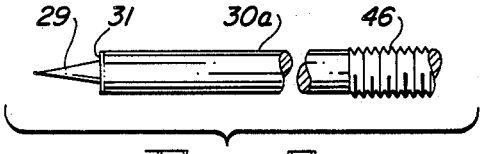
FIGS. 5 and 6 detail alternate embodiments of configurations of the metering rod and main metering jet respectively.
Figure 6:
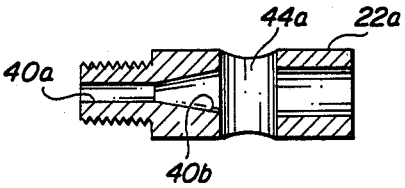

Alternate embodiments of configurations of both the metering rod and the main metering jet are illustrated in FIGS. 5 and 6. In FIG. 5, metering rod **30*a* has had its point changed to where the point 29 now extends from a formed shoulder 31, the base of point 29 being of a diameter less than the diameter of metering rod 30*a*. One obvious advantage of the configuration of metering rod 30*a* shown in FIG. 5 is that when bottoming metering rod 30*a* to the shoulder in main metering jet 22, the shoulder 29 of metering rod 30*a* abuts a similar shoulder in main metering jet 22. Since it is common to use brass metal in carburetor parts, such a alternate embodiment prevents the abrasion and possible deformation of the point of metering rod 30***a* and/or the shoulder of main metering jet 22.

In FIG. 6, main metering jet 22*a* has been modified to present a sloped frontal shaped entrance or sloped internal surface 40*b* to fuel orifice 40*a* in order to accommodate the pointed end of metering rod 30. By this manner, more delicate adjustment of metering rod 30 in the main metering jet 22*a* is accomplished.

While it is apparent in the description above that the Inventor has selected thread size on the adjustable metering rod, as well as orifice size in the main metering jets, to correspond to the different sizes of the standard stock Holley brand type fuel metering jets, it is obvious that precise adjustment of the jets between any two standard stock fuel metering jet sizes may be accomplished by the invention by simple rotation of the metering rod. The obvious purpose of relating a fixed number of turns to a standard stock fuel metering jet number is to present the racing enthusiast with the reference to which he may adjust the metering rods and thereby relate to known main metering jet sizes.

While a preferred embodiment has been shown and described, it will be understood that there is no intent to limit the invention by such disclosure, but rather it is intended to cover all modifications and alternate constructions falling within the spirit and the scope of the invention as defined in the appended claims.

I claim:

1. In a modular type high performance engine carburetor having a float bowl module with sides to contain fuel, said float bowl module juxtaposed a metering block module, said metering block module having an opening therein with internal threads to receive a main fuel metering jet, apparatus to provide external adjustment of the main fuel metering jet comprising:

an elongated metering rod having two ends, said metering rod including external threads on said rod;

a main fuel metering jet engaged by said elongated metering rod, said main fuel metering jet defining an elongated cylinder having a longitudinal opening therethrough, said longitudinal opening defining in part a fuel orifice of a first fixed diameter and in part a passageway having a second larger fixed diameter, said elongated cylinder having at one end external threads mating with the internal threads in the opening in the metering block module; and means to extend said metering rod through said float bowl module to outside the carburetor, said means including a cylindrical bushing having an elongated shank with a longitudinal opening therethrough to pass said metering rod, said elongated shank having external threads thereon and said longitudinal opening having internal threads therein, said internal threads receiving said elongated rod external threads in a liquid-tight relationship, said cylindrical bushing protruding through said float bowl module side opposite the metering block module, and a nut adapted to mate with said cylindrical bushing external threads to hold said bushing to said float bowl module side in a liquid-tight arrangement whereby external adjustment of said metering rod passing through said cylindrical bushing to the outside of the carburetor may be accomplished to vary fuel passage into the engine.

2. The apparatus to provide adjustment of the main fuel metering jet as defined in claim 1 wherein said main metering jet longitudinal opening passageway is adapted to receive a first end of said metering rod whereby said elongated metering rod may meter the fuel passing into said orifice.

3. The apparatus to provide adjustment of the main fuel metering jet as defined in claim 2 wherein said metering rod first end defines a pointed end, and said second end defines a screwdriver slot.

4. The apparatus to provide adjustment of the main fuel metering jet as defined in claim 3 wherein said metering rod pointed end resides within said main fuel metering jet longitudinal opening passageway with said pointed end proximate said fuel orifice.

5. The apparatus to provide adjustment of the main fuel metering jet as defined in claim 4 wherein said main fuel metering jet includes a transverse opening through said elongated cylinder, said transverse opening adapted to pass fuel by said metering rod pointed end into said fuel orifice whereby said metering rod may be adjusted by rotating said metering rod with a screwdriver operating in said screwdriver slot and thus constrict the effective area between the fuel orifice and the metering rod pointed end to vary the amount of fuel passing from the float bowl module into the fuel orifice and to the engine.

6. The apparatus to provide adjustment of the main fuel metering jet as defined in claim 5 wherein said metering rod resides snugly in said main fuel metering jet longitudinal opening passageway.

7. The apparatus to provide adjustment of the main fuel metering jet as defined in claim 6 wherein said main fuel metering jet fuel orifice defines an elongated opening having a sloped internal surface for a portion thereof, said sloped portion adapted to receive said metering rod pointed end.

8. The apparatus to provide adjustment of the main fuel metering jet as defined in claim 6 wherein said metering rod pointed end defines a pointed end extending from a formed shoulder of said metering rod.

* * * * *